US008066870B2

(12) United States Patent
Freeman et al.

(10) Patent No.: US 8,066,870 B2
(45) Date of Patent: Nov. 29, 2011

(54) SEPARATION OF TAR FROM SAND

(75) Inventors: Michael A. Freeman, Kingwood, TX (US); Alex Stoian, Calgary (CA); Lewis J. Dutel, Cypress, TX (US); Cory C. Melancon, Houston, TX (US); Richard Bingham, Katy, TX (US); Paul Newman, Bedford (CA)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 12/707,445

(22) Filed: Feb. 17, 2010

(65) Prior Publication Data

US 2010/0140145 A1 Jun. 10, 2010

Related U.S. Application Data

(62) Division of application No. 11/368,371, filed on Mar. 3, 2006, now Pat. No. 7,691,259.

(51) Int. Cl.
*C10G 1/04* (2006.01)

(52) U.S. Cl. ..... 208/390; 209/171; 209/213; 210/242.3

(58) Field of Classification Search ..... 208/390; 209/171, 213; 210/242.3
See application file for complete search history.

(56) References Cited

U.S. PATENT DOCUMENTS

| | | | | | |
|---|---|---|---|---|---|
| 2,453,060 | A | | 11/1948 | Bauer et al. | |
| 4,331,532 | A | * | 5/1982 | Bose | 208/391 |
| 4,566,964 | A | * | 1/1986 | Friedman | 208/433 |
| 4,673,484 | A | | 6/1987 | Babcock et al. | |
| 4,678,558 | A | * | 7/1987 | Belluteau et al. | 208/390 |
| 4,783,268 | A | | 11/1988 | Leung | |
| 5,290,433 | A | | 3/1994 | Chan et al. | |
| 5,340,467 | A | * | 8/1994 | Gregoli et al. | 208/390 |
| 5,480,566 | A | | 1/1996 | Strand | |
| 5,626,741 | A | | 5/1997 | Mosby et al. | |
| 5,795,444 | A | | 8/1998 | Rendall et al. | |
| 6,007,709 | A | | 12/1999 | Duyvesteyn et al. | |
| 6,153,017 | A | * | 11/2000 | Ward et al. | 134/10 |
| 6,547,960 | B1 | | 4/2003 | Yamauchi | |
| 6,746,599 | B2 | | 6/2004 | Cymerman et al. | |
| 2007/0272596 | A1 | * | 11/2007 | Erasmus et al. | 208/400 |

OTHER PUBLICATIONS

Sinnott, R.K. (2005). Chemical Engineering Design, 4th ed., Elsevier, 1038 pgs. (Office action references p. 402 & and Section 10.4).*

Office Action for Canadian Application No. 2,580,098, dated Sep. 1, 2009, 4 pages.

Official Action issued in related Canadian Patent Application No. 2,580,098; Dated Jun. 14, 2010 (2 pages).

* cited by examiner

*Primary Examiner* — Robert J Hill, Jr.
*Assistant Examiner* — Brian McCaig
(74) *Attorney, Agent, or Firm* — Osha Liang LLP

(57) ABSTRACT

A system for separating hydrocarbons from a solid source including a primary separation tank including a first hydrocarbon removing device to remove hydrocarbons from a slurry of water and solids. Further, the system including a transfer device between the primary separation tank and a secondary separation tank, wherein the transfer device is configured to transfer solids from the slurry to the secondary separation tank. Further still, the system including a second hydrocarbon removal device, a fine particle separation device to remove remaining solids in the secondary separation tank, and a product collection tank to receive hydrocarbons removed from the primary and secondary separation tanks.

15 Claims, 6 Drawing Sheets

SEPARATION OF TAR FROM SAND

CROSS-REFERENCE TO RELATED APPLICATIONS

This is a divisional application and claims benefit under 35 U.S.C. §120 of U.S. patent application Ser. No. 11/368,371, filed on Mar. 3, 2006, now U.S. Pat. No. 7,691,259.

FIELD OF THE INVENTION

This disclosure invention relates generally to a method for extracting hydrocarbon "bitumen" from rocks, clay, and mined oil sand.

BACKGROUND OF THE INVENTION

Throughout the world, considerable oil reserves may be found locked in the form of tar/oil sand, also known as bitumen sand. Bitumen, which is a viscous hydrocarbon, is trapped between the grains of sand, clay, and water. Because the recovery of bitumen from the sand may provide an increasingly valuable commercial energy source, processes for extracting and refining bitumen have long been investigated.

One method for recovering tar sand is by mining. In these operations, surface or shallow oil sands are open pit mined. The cost of mining increases with the depth of burial of the formation. At some point, the amount of overburden and the cost of its removal becomes too great. These deeper deposits have recently begun to be exploited by drilling wells through the overburden. In some cases, the bitumen behaves as a fluid under reservoir conditions, and may flow into the well for production by conventional means. However, in other cases, the bitumen is either too viscous or is too solidified, and may not flow. To recover these deposits, steam or other heat sources may be introduced into the tar sand formation to liquefy the bitumen. Recently, a technique of drilling closely spaced horizontal wells that allow a controlled passage of steam therebetween has become popular. After months of steaming, the molten tar flows into collection wells for recovery. So-called Steam Assisted Gravity Drainage is one such technique.

In Alberta, the tar sands underlie a wide expanse of undeveloped and environmentally sensitive areas in the north of the province. Drilling wells inevitably creates large amounts of overburden and tar sand cuttings. Currently, tarred cuttings must be hauled to either existing mining operations or permitted disposal sites. Therefore, processes that separate tar from sands at the drill site and allow delivery of sands clean enough for on-site disposal may reduce the cost of drilling.

Similar problems may occur when attempting to remove tar from drilled cuttings as those encountered when trying to recover tar from mined sand. However, when removing tar from drilled cuttings, surfactants, substances present in drilling fluid, and substances otherwise used to facilitate tar removed during the drilling process may contaminate the drilled cuttings. Such substances may cause environmental concerns if not removed from the drilled cuttings prior to disposal.

Currently, extraction of the bitumen from oil sand and drilled cuttings may be accomplished though a number of different processes. One process involves mixing the oil sand with hot water, an example of which is disclosed in U.S. Pat. No. 5,626,741, hereby incorporated by reference herein. In the hot water extraction process, oil sands are first conditioned in large conditioning drums or tumblers with the addition of NaOH and water at a temperature of about 85° C. The tumblers provide means for steam injection and physical action to mix the resultant slurry vigorously, causing the bitumen to be separated from the oil sands, and then aerated to form bitumen froth.

The slurry from the tumblers is then screened to separate out the larger debris and passed to a separating cell where settling time is provided to allow the slurry to separate. As the slurry settles, the bitumen froth rises to the surface and the sand particles and sediments fall to the bottom. A middle viscous sludge layer, termed middlings, contains dispersed clay particles and some trapped bitumen that is not able to rise due to the viscosity of the sludge. Once the slurry has settled, the froth is skimmed off for froth treatment and the sediment layer is passed to a tailings pond. The middlings are often fed to a secondary flotation state for further bitumen froth recovery.

Bitumen froth contains bitumen, solids, and trapped water. The solids that are present in the froth are in the form of clays, silt, and sand. From the separating cell, the froth is passed to a defrothing or deaerating vessel where the froth is heated and broken to remove the air. Typically, naphtha is then added to solvate the bitumen to reduce the density of the bitumen and to facilitate separation of the bitumen from the water by means of a subsequent centrifugation treatment. The centrifuge treatment typically involves a gross centrifuge separation followed by a series of high-speed centrifuge separations. The water and solids released during the centrifuge treatment are passed to the tailings pond, while recovered bitumen may then be transferred for further processing.

When bitumen is treated using the conventional naphtha dilution and centrifugation extraction process, considerable problems may be encountered. First, the naphtha-diluted bitumen product may contain up to 5 wt % water and solids. Second, the naphtha dissolves the bitumen as well as the unwanted and dirty asphaltenes contained in the bitumen froth. The contamination of bitumen oil may result in inefficient end product production, specifically, when hydrocracking is used. Hydrocracking is a process which uses hydrogen gas and a catalyst to separate a reagent into various products. Hydrocracking may produce, among other end products, naphtha and distillates. Because hydrocracking requires a homogeneous feed, which is low in solids and water, the naphtha diluted bitumen product cannot be fed directly to the hydrocracker. In order to use the naphtha diluted bitumen product, it must first be coked to drive off the naphtha solvent and drop out the asphaltenes and solids. Unfortunately, this coker upgrading represents a substantial capital outlay and results in a loss of 10-15% of the bitumen initially available for hydrocracking.

Additional methods of further removing bitumen from oil sand have also been proposed, including a method for cleaning post-primary bitumen froth (i.e. bitumen froth collected after initial skimming) containing bitumen, water, and solids, which is disclosed in U.S. Pat. No. 5,290,433, hereby incorporated by reference herein. This method includes introducing a bitumen-containing solution into a chamber through a tube carrying one or more pairs of opposed throw propellers. The propellers shear the froth, causing the froth to exit the tube in different directions, thereby separating the solids from the aerated bitumen which rises to the top, forming a new froth. The newly formed bitumen-containing froth may then be collected, while the middlings are withdrawn from the chamber and recycled to join the feed. While this process of removing bitumen is useful in collecting bitumen from post-primary bitumen froth, its utility is limited in that the middlings are simply recycled through the same process.

Because of the limitations of single step systems, as those disclosed above, larger systems have been developed to more efficiently remove bitumen from oil sand. One such system is disclosed in U.S. Pat. No. 5,795,444, which is hereby incorporated by reference herein. In this process, the oil sand is stirred to form a slurry with hot water and steam. The injection of hot water and steam may cause bitumen oils, sand, and water, to segregate into layers in a flotation vessel. The flotation vessel is then skimmed to remove the bitumen oil from the sand and water, while the remaining slurry is transferred to a hydrocyclone. The hydrocyclone further separates bitumen oil from the slurry, diverting the hydrocyclone overflow to a thickening vessel. The remaining bitumen oil then floats to the surface of the thickening vessel, while any remaining water and sand are transferred to a sand washer, whereby the process repeats.

While this system provides multiple means for separating bitumen from sand, its effectiveness is limited by the single flotation cell skimmer. Additionally, the system does not provide a means for recycling water throughout the process. Thus, the advantages of the system are restricted by the constant need for water, as well as the inefficiency of a system that only extracts bitumen from a single source, namely the flotation cell skimming.

Such processes as those mentioned above have not facilitated the efficient extraction of bitumen oil from oil sands. The aforementioned processes either haven't been adopted by the industry due to the fact that they substantially increase the cost of bitumen extraction, or have been adopted but result in high levels of hazardous waste product. Accordingly, there exists a need for a process that increases the production of bitumen oil from oil sand, while decreasing levels of hazardous waste and producing substantially cleaner sands.

BRIEF SUMMARY OF THE INVENTION

According to one aspect of the present disclosure, a system for separating hydrocarbons from a solid source includes a primary separation tank including a first hydrocarbon removing device to remove hydrocarbons from a slurry of water and solids. Further, the system includes a transfer device between the primary separation tank and a secondary separation tank, wherein the transfer device is configured to transfer solids from the slurry to the secondary separation tank. Further still, the system includes a second hydrocarbon removal device, a fine particle separation device to remove remaining solids in the secondary separation tank, and a product collection tank to receive hydrocarbons removed from the primary and secondary separation tanks.

According to another aspect of the present disclosure, a method for separating hydrocarbons from a solid course includes mixing a tarred solid source with water to create a slurry of water, solids, and hydrocarbons in a primary separation tank, separating at least a portion of the hydrocarbons from the slurry by settling, floatation, mechanical agitation, water circulation, aeration, gravity separation, or counter-current decantation. Further, the method includes removing at least a portion of the separated hydrocarbons from the slurry, transferring the remaining slurry into a secondary separation tank, filtering the slurry to remove solid particles, removing additional hydrocarbons, and recycling the water.

According to another aspect of the present disclosure, a method to separate hydrocarbons from a solid source includes a system that includes separating hydrocarbons from a solid source includes a primary separation tank including a first hydrocarbon removing device to remove hydrocarbons from a slurry of water and solids. Further, the system includes a transfer device between the primary separation tank and a secondary separation tank, wherein the transfer device is configured to transfer solids from the slurry to the secondary separation tank. Further still, the system includes a second hydrocarbon removal device, a fine particle separation device to remove remaining solids in the secondary separation tank, and a product collection tank to receive hydrocarbons removed from the primary and secondary separation tanks.

Other aspects and advantages of the invention will be apparent from the following description and the appended claims.

DESCRIPTION OF ILLUSTRATIVE EMBODIMENTS

Figure 1:
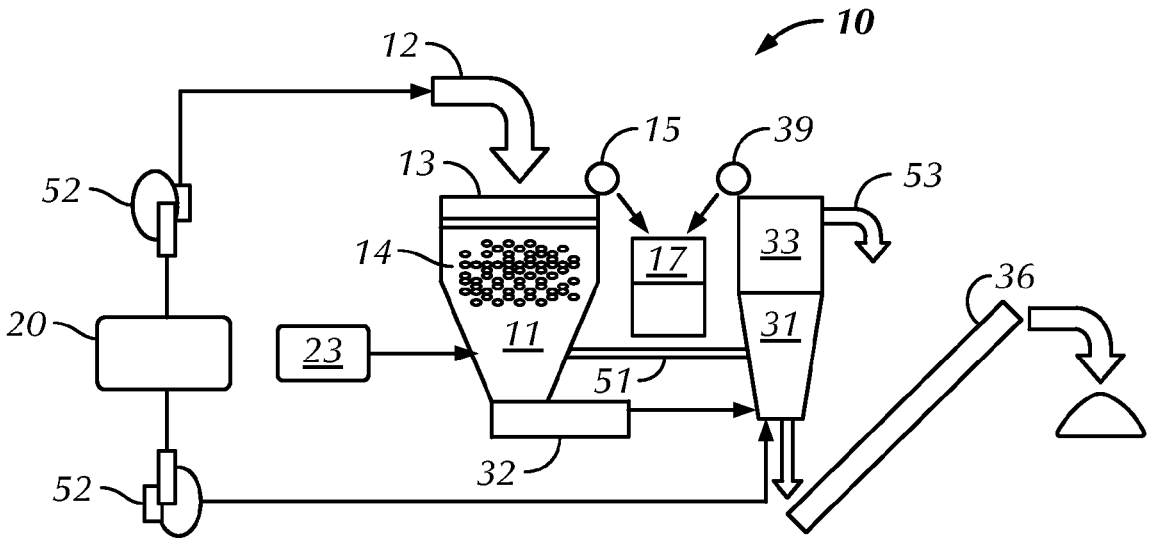
FIG. 1 is a schematic view of an embodiment of a system in accordance with the present disclosure.
Figure 1A:
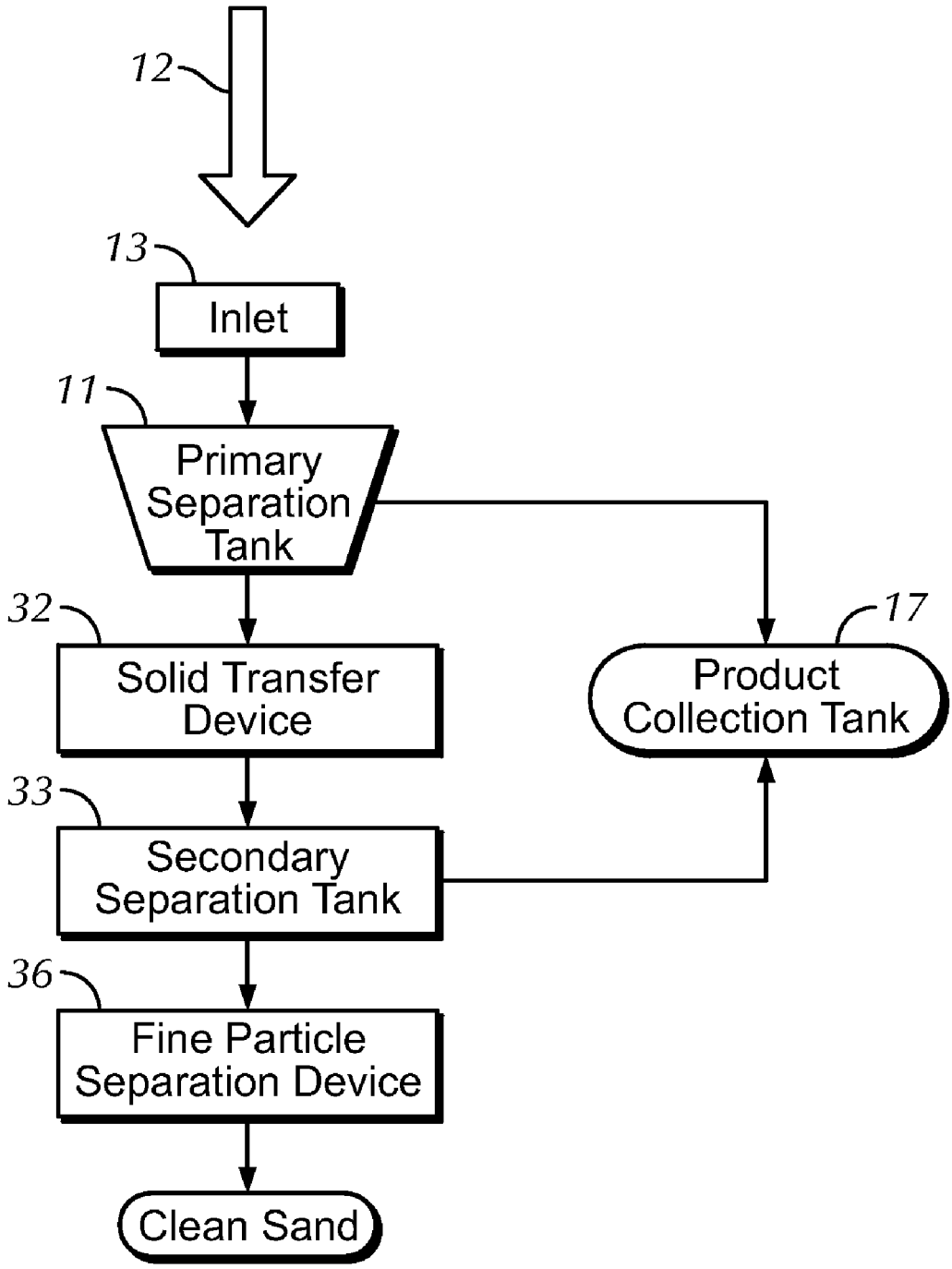
FIG. 1*a* is a block diagram of the flow process of the system shown in FIG. 1.

In general, embodiments disclosed herein relate to systems and methods for recovering bitumen oil. Referring initially to FIGS. 1 and 1*a* together, a system 10 for removing bitumen oil from oil sand 12 in accordance with an embodiment is shown. System 10 includes a primary separation tank 11 where oil sand 12 and solid matter (containing bitumen oil and cuttings) may be introduced. In one embodiment, oil sand 12 may be introduced into system 10 through an inlet 13 configured to mix oil sand 12 with water, thereby creating a first slurry 14. First slurry 14 may then separate in primary separation tank 11.

In one embodiment, the initial separation of first slurry 14 may take place through gravity separation. To provide gravity separation, primary separation tank 11 may be any holding vessel known to one skilled in the art used in the process of oil/water separation. Gravity separation devices work on the principle of Stokes' Law:

$$V_s = gd^2(p_p - p_m)/18\mu$$

wherein $V_s$=settling rate, g=acceleration of gravity, $P_p$=density of particle, $P_m$=density of medium, and μ=viscosity of medium. Stokes' Law defines the rise velocity of an oil particle based on its density and size. Lighter particles, like bitumen oil (i.e. those having a relatively low specific gravity) tend to float to the surface, while heavier particles, like sand (i.e. those having a relatively high specific gravity) tend to settle to the bottom of primary separation tank 11. Because the specific gravities of bitumen oil and water tend to be closer than the specific gravities of bitumen oil and particulate contaminated water, the contaminated water tends to settle to the bottom of primary separation tank 11, along with the sand.

Still referring to FIG. 1, as the bitumen oil rises to the top of primary separation tank 11, a first hydrocarbon removing device 15 may be used to remove the bitumen oil from the surface of the water. In one embodiment, first hydrocarbon removing device 15 may be a disc skimmer. As the disc skimmer removes bitumen oil from the surface of first slurry 14, the bitumen oil may be transferred into a product collection tank through a conveying line (not shown in detail), an overflow, or any other process known to one of ordinary skill in the art.

To facilitate the initial separation of bitumen oil from oil sand 12, a stream of hot water may be added to oil sand 12 at inlet 13. In one embodiment, hot water may be supplied from a water heater 20 and transferred to inlet 13 through a water pump 15, or any other process known to one of ordinary skill in the art. In certain embodiments, heating the water to about 90° C. may increase the rate that bitumen oil separates from oil sand 12, clay, or other solids.

While gravity separation may encourage bitumen oil to separate from solids, agitation of first slurry 14, in primary separation tank 11, may assist in the process. In one embodiment, the agitation of first slurry 14 may occur through aeration supplied to primary separation tank 11 from an air compressor 23. The air may be added to first slurry 14 through holes drilled in the bottom of primary separation tank 11. As the air rises through first slurry 14, the air may promote the separation of bitumen oil from solids by trapping the bitumen oil on the surface of bubbles. The bubbles may then rise to the surface of first slurry 14 in the form of a froth. The froth may be removed from primary separation tank 11 by first hydrocarbon removing device 15, and transferred to product collection tank 17. In certain embodiments, it may be beneficial to use hot water separation, air agitation, and other processes of separation known to one of ordinary skill in the art, in the same system, to increase the rate of bitumen oil separation.

Still referring to FIG. 1, while bitumen oil may separate from first slurry 14, and layer on the top of primary separation tank 11, solids may settle toward the bottom of primary separation tank 11. Between the layer of primarily solids, and the layer of primarily bitumen oil, a middle layer of first slurry 14 may form. The middle layer may contain fine particles, bitumen oil, and water. Because the middle layer may contain bitumen oil, it may be beneficial to transfer the middle portion of first slurry 14 to a secondary separation tank 33. The middle layer of first slurry 14 may be transferred to secondary separation tank 33 via direct piping 51, siphoning, through a pumping device (not shown in detail), or by any other process known to one of ordinary skill in the art.

While the middle layer of first slurry 14 may be transferred to separation tank 33 as described above, the solids that may have settled to the bottom of primary separation tank 11 may also be transferred. To transfer solids from primary separation tank 11 to secondary separation tank 33, a solid transfer device 32 may be used. In one embodiment, solid transfer device 32 may be a variable pitch screw auger (not shown in detail). As solids settle to the bottom of primary separation tank 11, the solids of first slurry 14 may enter the auger. The auger may transfer the solids directly into secondary separation tank 11, or may provide additional components to facilitate the separation of bitumen oil from the solids. For example, in certain embodiments, a stream of hot water may be introduced into the auger to promote the separation of remaining bitumen oil from the solids. While hot water separation is one method of bitumen oil separation that may be used in solids transfer device 32, embodiments employing other processes of separation may be foreseen, and are within the scope of this disclosure.

Still referring to FIG. 1, a second slurry may form in secondary separation tank 33 including the middle layer of first slurry 14, and the solids from solid transfer device 32. Second slurry 31 may initially separate through gravity separation, as described above. However, in certain embodiments, it may be advantageous to use any of the agitation processes used in primary separation tank 11 to increase the rate bitumen oil separates from the solids. In one embodiment, hot water may be introduced into secondary separation tank 33. The hot water may be supplied to secondary separation tank 33 by a water pump 51 connected to water heater 20. In such an embodiment, it may be beneficial to introduce the hot water into the bottom of secondary separation tank 33 so that the hot water has greater contact with the solids. As the hot water contacts the solids, additional bitumen oil may separate from the solids and rise to the top of secondary separation tank 33 as described above.

Alternatively, agitation of second slurry 31 may be induced through the injection of air into secondary separation tank 33. In one embodiment, air may be injected into the bottom of secondary separation tank 33 from air compressor 23. Aeration may promote the separation of bitumen oil from solids, as described above. It should be realized that in certain embodiments, any of the aforementioned methods of agitating the first slurry may be used together, no method of agitation may be used at all, or other methods known to those of ordinary skill in the art may be used.

As the bitumen oil is released from the solids, it may rise to the top of secondary separation tank 33. The oil may then be removed from secondary separation tank 33 by a second hydrocarbon removing device 39. In one embodiment, second removing device 39 may be a disc skimmer (not shown in detail). As the disc skimmer removes bitumen oil from the surface of second slurry 31, the bitumen oil may be transferred to product collection tank 17 as described above.

To remove the solids from secondary separation tank 33, a fine particle separation device 36 may be configured to secondary separation tank 33. In one embodiment, fine particle separation device 36 may be an auger (not shown in detail). In such an embodiment, as solids settle toward the bottom of secondary separation tank 33, the solids may enter the auger. As the solids travel through the auger toward an exit location, liquid may drain off of the solids and back into secondary separation tank 33. Upon exiting the auger, the cleaned solids may exit the system, or in certain embodiments, enter another separation tank for additional cleaning.

Referring back to FIG. 1, as the bitumen oil rises to the top of secondary separation tank 33, and the solids settle to the bottom of secondary separation tank 33, a middle layer in second slurry 31 may form. The middle layer in second slurry 31 may contain water and clay. In some embodiments, the middle layer in second slurry 31 may be removed from secondary separation tank 33, to a dewatering unit (not shown), via direct piping 53, siphoning, through a pumping device (not shown), or by any other process known to one of ordinary skill in the art. The dewatering unit may promote the separation of clay from water, such that the cleaned water may be recycled. In certain embodiments, the cleaned water may be recycled into system 10 through water heater 20, forming a closed-loop water cycle.

Figure 1B:
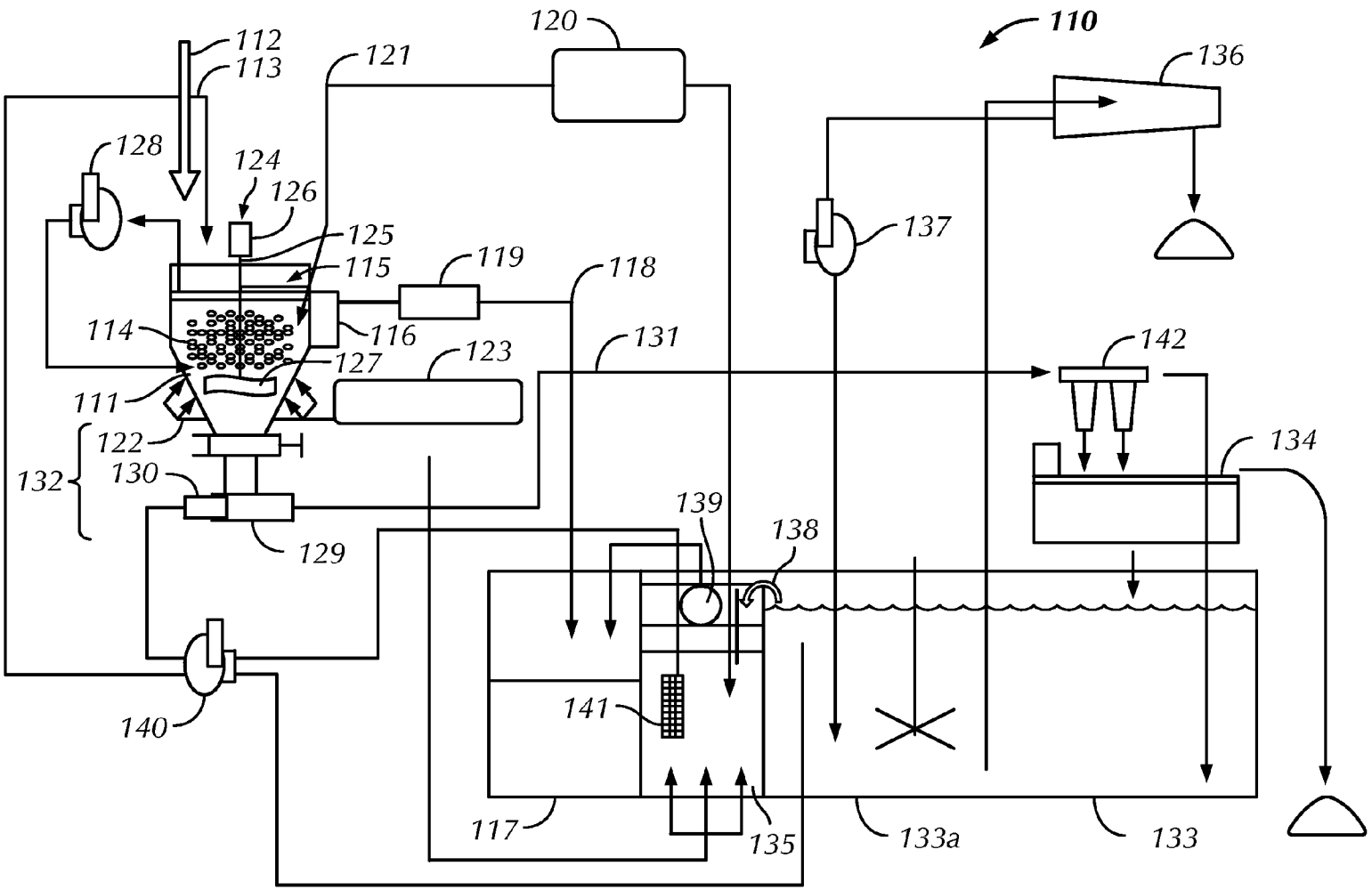
FIG. 1*b* is a schematic view of an alternate embodiment of a system in accordance with the present disclosure.

Referring now to FIG. 1*b*, an alternate embodiment of a system 110 for removing bitumen oil from oil sand is shown. The system 110 includes a primary separation tank 111 where oil sand 112 and solid matter (containing bitumen oil and cuttings) may be introduced. In one embodiment, oil sand 112 may be introduced into system 110 through a first inlet 113 configured to mix the oil sand 112 with water, thereby creating a first slurry 114. First slurry 114 may then separate in primary separation tank 111 as described above.

Still referring to FIG. 1*b*, as the bitumen oil rises to the top of primary separation tank 111, a first hydrocarbon removing device 115 may be used to remove the bitumen oil from the surface of the water. In one embodiment, first hydrocarbon removing device 115 may be a rotary skimmer. As the rotary skimmer collects the bitumen oil, the oil may be transferred to an overflow 116 attached to primary separation tank 111. The bitumen oil may then be transferred to a product collection tank 117 via a conveying line 118 through positive displacement provided by pump 119. While this is one method of transferring the bitumen oil, it should be recognized that any method of transferring the separated bitumen oil from primary separation tank 111 to product collection tank 117 is within the scope of this disclosure.

While gravity separation may facilitate in the initial separation of bitumen oil from solids, the initial separation of first slurry 114 may be further assisted by its agitation in primary separation tank 111. As shown in FIG. 1*b*, a boiler 120 may be attached to primary separation tank 111 to introduce steam 121 into first slurry 114. As steam 121 interacts with first slurry 114, the bitumen oil may separate from oil sand 112 and the water to form a froth on the surface of first slurry 114. The froth may then be removed from the surface of first slurry 114 and transferred to product collection tank 117 in the method described above.

Alternatively, agitation to first slurry 114 may be provided through a stream of air 122 introduced into the first slurry 114 through an air compression device 123 attached to primary separation tank 111. In one embodiment, air 122 may be introduced in the form of microbubbles that travel through first slurry 114 inducing separation of the bitumen oil from oil sand 112 and the water. As the bitumen oil separates from the oil sand 112 and water, it floats to the surface of primary separation tank 111 in the form of a froth that may be removed from primary separation tank 111 through any method described above.

Alternatively still, agitation to first slurry 114 may be provided by a stirring device 124. As depicted in FIG. 1*b*, stirring device 124 may be a shaft 125 actuated by a motor 126. To provide movement in first slurry 114, one or more propellers 127 may be attached along shaft 125. To promote separation of the bitumen oil from first slurry 114, propellers 127 may be configured to provide specific flow dynamics (e.g. directional or counter-current flow). It should be realized that in certain embodiments, any of the aforementioned methods of agitating the first slurry may be used together, no method of agitation may be used at all, or other methods known to those of ordinary skill in the art may be used.

Figure 2:
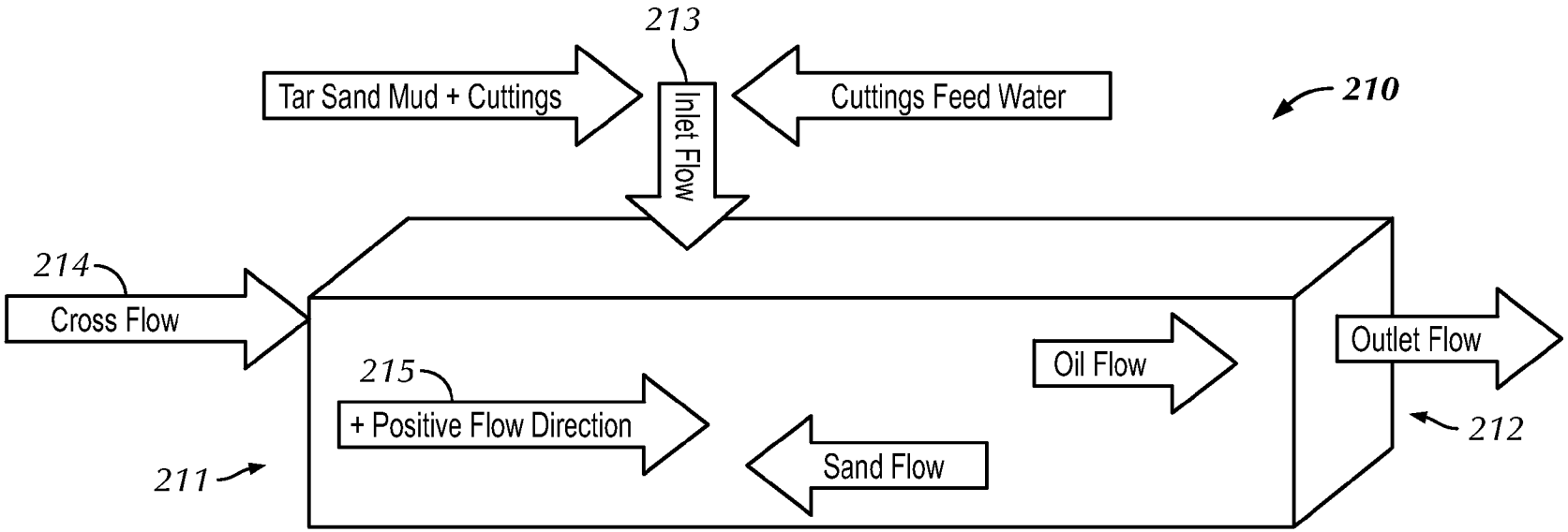
FIG. 2 is an illustrated view of a counter-current flow in accordance with embodiments of the present disclosure.

Referring briefly to FIG. 2, in one embodiment, primary separation tank 111 may be an American Petroleum Institute (API) separator 210. Oil sand, mud, and cuttings may be mixed with water and introduced into API separator 210 through a first inlet 213 creating a counter-current flow. A cross flow 214 may be produced using a circulation pump (128 of FIG. 1*b*). Cross flow 214 of water creates a positive flow direction 215 whereby bitumen oil flows toward effluent end 212 and sand moves toward inlet end 211. While this is one method of creating a counter-current in primary separation tank 111, other methods may be foreseen wherein bitumen oil is collected by any means known to one of ordinary skill in the art. For example, in certain embodiments, it may be beneficial to use coalescing plate or inclined plate separators to increase the rate of bitumen oil extraction from oil sand 112.

Additionally, a modification to primary separation tank 111 wherein a chain-and-flight scraper may be used to facilitate the movement of sand away from the bitumen oil may be foreseen. API separator 210 may be configured with a chain-and-flight scraper to move oil sand 112 and solids throughout the vessel. Generally, a system using a chain-and-flight scraper will move solids to an inlet end 211 of API separator 210 while floating bitumen oils to an effluent end 212 of the of the separator. A system employing a chain-and-flight scraper (not shown separately) may be of specific advantage when processing large quantities of sand in a single run.

Alternative modifications to primary separation tank 111 may also include a movable first water inlet that allows solids to be injected into primary separation tank 111 at selectable points along the tank. By varying the entry location of the solids, the height of the solids in primary separation tank 111 may be kept relatively level thereby promoting the extraction of bitumen oil. In addition to a movable first water inlet, a second water inlet may be foreseen wherein a horizontal flow of water flows through the tank substantially continuously washing the solids. These modifications may be used independently, in conjunction with aforementioned aspects of primary tank design, or not at all, depending on the requirements of the solids being processed.

Referring back to FIG. 1*b*, primary separation tank 111 may be fluidly connected to a solid transfer device 132. In certain embodiments, solids transfer device 132 may include an eductor system 129. Via a fluid connection, the eductor system 129 receives the solids which have settled to the bottom of primary separation tank 111. In the eductor system 129, water may be provided through second water inlet 130 in order to mix with the solids, thereby creating a second slurry 131. Second slurry 131 may be transferred to a solid separation device 132 connected to the eductor system 129. One solid separation device that may be used is a hydrocyclone. In a hydrocyclone system, second slurry 131 may be fed tangentially into the larger diameter portion of the cone. The spinning effect of the hydrocyclone forces solids to the edge of the cone where they slide down the sides of the device exiting from the bottom. The solids, consisting of cleaned sand and cuttings may then be collected. The liquid portion of second slurry 131, generally including the water and bitumen oil, exits the top of the hydrocyclone and enters a secondary separation tank 133.

In one embodiment, the eductor system 129 may include a variable pitch screw auger (not shown). In certain embodiments, the variable pitch screw auger may be placed with an inlet at the bottom of primary separation tank 111. As the screw auger contacts the solids, the solids may be drawn out of primary separation tank 111 along a screw conveyer. As the solids are transferred out of primary separation tank 111 along the screw conveyer, water may drain back into primary separation tank 111 for further processing. During or after transference through the variable pitch screw auger, the solids may be washed with water, treated with additives, or otherwise deposited in a solid separation device 142 or secondary separation tank 133. While only a variable pitch screw auger is described above, it should be understood that any transference device known to one skilled in the art may be used to move solids from primary separation tank 111 to secondary separation tank 133.

In one embodiment, upon exiting the eductor system 129 or solid separation device 142, the solids may pass through a shale shaker 134. Shale shaker 134 accepts the solids from solid separation device 132, and is configured to attach to secondary separation tank 133. Generally, the shale shaker 134 is a vibrating sieve, wherein as solids and residual second slurry 131 move over a cloth or mesh screen, liquids and solids smaller than the mesh pass through the screen into the secondary separation tank. Larger particles, including cuttings, retained on the screen, travel to the end of shale shaker 134, and are collected therefrom. The portion of second slurry 131 that passes through shale shaker 134 mixes with a solution in second separation tank 133.

Upon entering the second separation tank 133, gravity separation may allow remaining bitumen oils to layer toward the surface, while the particulate matter layers toward the bottom. The particulate matter that layers toward the bottom of secondary separation tank 133 may then enter a fine particle separation device 136. The fine particle separation device 136 may be external to secondary separation tank 133 or inside secondary separation tank 133.

In one embodiment, the particulate matter may flow out of the secondary separation tank 133 into fine particle separation device 136 via an outlet located at a height level on secondary separation tank 133 where the particulate matter layers. However, in other embodiments, the particulate matter may be removed from secondary separation tank 133 with either an internal or external water pump. In one embodiment, fine particle separation device 136 may be a centrifuge. Generally, the centrifuge consists of a rotating conical drum actuated by an external motor. A mixture of fine particulate matter (e.g. sand, fine cuttings, middlings) and water enters one end of the centrifuge. As the drum rotates, separated solids exit from one end for collection, while the mixture of water and remaining bitumen oil exits the second end and are thereby transferred to a partitioned section 133*a* of secondary separation tank 133. In some embodiments, use of a transfer pump 137 may be foreseen to facilitate movement of the water and bitumen oil into the partitioned section of secondary separation tank 133*a*.

In certain embodiments, fine particle separation device 136 may be a discharge auger (not shown in detail). The discharge auger may be placed with an inlet in secondary separation tank 133. As solids layer toward the bottom of secondary separation tank 133, the discharge auger removes the solids, while draining any liquids back into secondary separation tank 133. The discharge auger may be a solid state discharge auger, a screw auger, or any other auger style conveying device known to one of ordinary skill in the art.

Referring to FIG. 1*b*, the partitioned section of secondary separation tank 133*a* may allow bitumen oil to separate from the water. As bitumen oil layers to the top of the partitioned section of secondary separation tank 133*a*, the bitumen oil may be transferred into a final separation tank 135 by, for example, an overflow 138. Final separation tank 135 may allow the bitumen oil to separate from the water by gravity separation. However, in some embodiments, agitation from steam, air, or physical movement, as described above, may be used to stimulate the separation of the bitumen oil. As layers form in the water, a second hydrocarbon removing device 139 may be used to remove the bitumen oil whether layered, or as a froth.

In one embodiment, second hydrocarbon removing device 139 may be a drum skimmer (i.e. an oil roll skimmer). Generally, a drum skimmer contains an external drive that rotates a drum. As the drum rotates over the surface of the water, bitumen oil adheres to the surface of the drum, and a blade removes the accumulated oil from the surface of the skimmer. The bitumen oil then flows through a collection trough and into product collection tank 117. Use of a drum skimmer may be advantageous because it will not remove floating debris, thereby maintaining the purity of the collected bitumen oil.

While the embodiment of system 110 described above includes a secondary separation tank 133 and a final separation tank 135, it should be realized that in certain embodiments, the described components of final separation tank 135 may be included in secondary separation tank 133. In such an embodiment, final separation tank 135 may remain in system 110 as a water repository, or may be removed from system 110 entirely. Embodiments may also be foreseen, wherein fine particle separation device 136, second hydrocarbon removing device 139, and the water outlet to primary separation tank 111 are included in different tanks. In such a system, all of the secondary separation tanks 133 may remain operatively connected, while serving different functions. In still another embodiment, a system 110 may be foreseen, wherein there are any number of tanks including multiple stages of fine particle separation, skimming, and water transference.

In certain embodiments, surfactants, wetting agents, causticizing agents, and other chemical cleaning substances may be used either by direct addition to the described processes or as additives to the mechanical and hydraulic processes used to remove the tar sand from the mined or drilled deposits. Further, specified ranges of temperature and pH may be used to facilitate bitumen oil extraction. Specifically, in embodiments wherein the temperature of the solids as they enter the system is at either ambient temperature or the temperature of the fluid returning from the well, the process temperature may be above 50° C., preferably above 75, and the water feed temperature is about 90° C. may increase the efficiency of bitumen oil extraction. Steam heat may also be used in systems including a boiler. While these temperature ranges may promote efficient bitumen oil extraction, the use of temperatures outside this range may be foreseen, and as such, are within this disclosure. Additionally, a system wherein the process maintains alkaline pH, of about 10, and preferably above 11, may also facilitate bitumen extraction.

Figure 3:
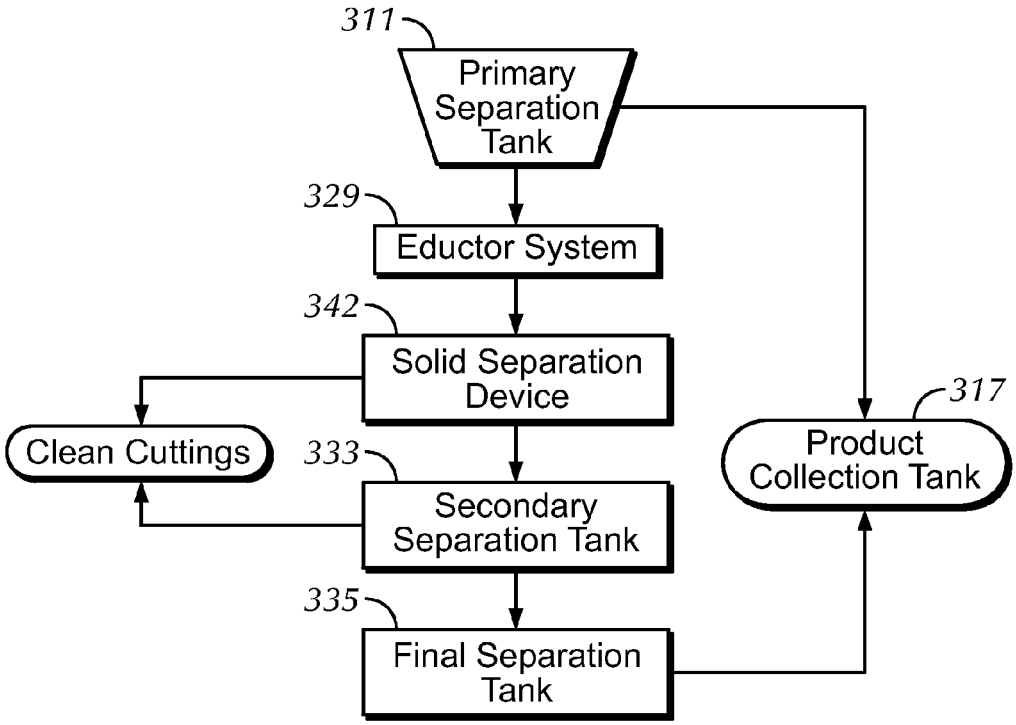
FIG. 3 is a block diagram of the flow process of the system shown in FIG. 1*b*.

Referring to FIG. 3, a block diagram of the process flow of one embodiment is shown. Oil sand and water enter primary separation tank 311 wherein bitumen oil is collected and transferred to a product collection tank 317. The remaining solids exit primary separation tank 311 and enter an eductor system 329. The eductor system 329 mixes the solids with water and transfers the slurry to a solid separation device 342. Solid separation device 342 removes large and medium size cuttings for collection. The remaining slurry may be transferred to a secondary separation tank 333. Secondary separation tank 333 uses a fine particle separation device (e.g. 136 of FIG. 1*b*) to remove fine particulate matter from the solution. The fine particulate matter is separated out for collection, and the remaining solution of water and bitumen oil is transferred to a final separation tank 335. Final separation tank 335 may use a second hydrocarbon removing device (e.g. 139 of FIG. 1*b*) to remove the bitumen oil to product collection tank 317.

Figure 4:
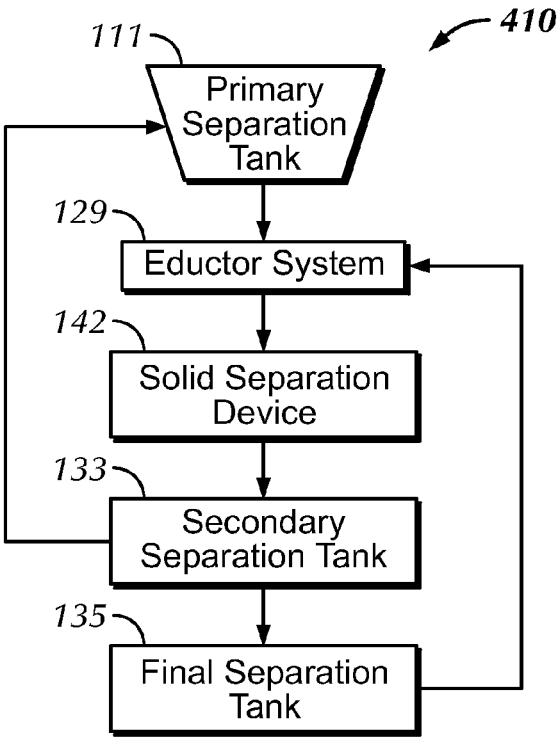
FIG. 4 is a block diagram of a closed loop water cycle of the flow process shown in FIG. 3.

Referring to FIG. 1*b* and FIG. 4 together, a water flow block diagram of a closed loop water cycle 410 of an embodiment of FIG. 1*b* is shown. Oil sand, cuttings, and other solid matter may enter system 110 through first water inlet 130 of primary separation tank 111. Water from an outlet on secondary separation tank 133 may also flow into first water inlet 130 of primary separation tank 111, therein mixing with the solids as they are added to system 110. Water transfer between secondary separation tank 111 and primary separation tank 111 may be assisted by an external water pump 140, or any other means of inducing water transfer known to one skilled in the art, for example, through an in tank water pump or by siphoning.

Water may then flow from primary separation tank 111 into eductor system 129. The eductor system 129 may receive additional water from final separation tank 135. In one embodiment, the water may exit through an outlet in final separation tank 135 and flow into a second water inlet 130 of eductor system 129. The water transfer may be assisted by external water pump 140, a separate water pump, or any other means of inducing water transfer know to one skilled in the art. In eductor system 129, the water from final separation tank 135 mixes with the solids and fluids from primary separation tank 111.

The water from eductor system 129 may then flow into solid separation device 132 for processing. After processing, the water may then flow into secondary separation tank 133 by overflow, piping, or any other means of transference. In some embodiments, the water may flow directly into secondary separation tank 133, while in other embodiments, the water may flow through a second solid separation device, for example a shake shaker 134.

The water may then flow from secondary separation tank 133 into fine particle separation device 136. After processing in fine particle separation device 136, the water may then flow back into secondary separation tank 133 or any partition of secondary separation tank thereof. The cycle of water from secondary separation tank 133 to fine particle separation device 136 may be induced by transfer pump 137, or any other water flow device known to one skilled in the art. Some of the water may exit secondary separation tank 133 through an outlet configured to connect with primary separation tank 111 as described above.

Upon processing by fine particle separation device 136, water not directed to primary separation tank 111 may flow from secondary separation tank 133 (or any partition thereof) into final separation tank 135. The water flow from secondary separation tank 133 to final separation tank 135 may occur through overflow 138 or mechanical means.

The solution in final separation tank 135 will consist primarily of water and bitumen oil. As the bitumen oil is removed to product collection tank 117, the water may be transferred to eductor system 129 as described above. To prevent the reprocessing of bitumen oil or residual solid matter, a filter 141 may be attached to the outlet connecting final separation tank 135 to eductor system 129.

The closed loop water cycle 410 disclosed above may allow water to be recycled through system 110 with increased efficiency. Advantageously, closed loop water cycle 410 may recycle the initial water in system 110, thus reducing operating costs. Additionally, by recycling the water in a system using heated water, less water may have to be heated, driving down operating costs even further. Moreover, closed loop water cycle 410 may allow levels of pH (e.g. causticity) to be monitored and maintained with greater accuracy and ease. Because less external water may be added to system 110, less caustic reagent may be required, thus decreasing operating costs while increasing system efficiency.

Figure 5:
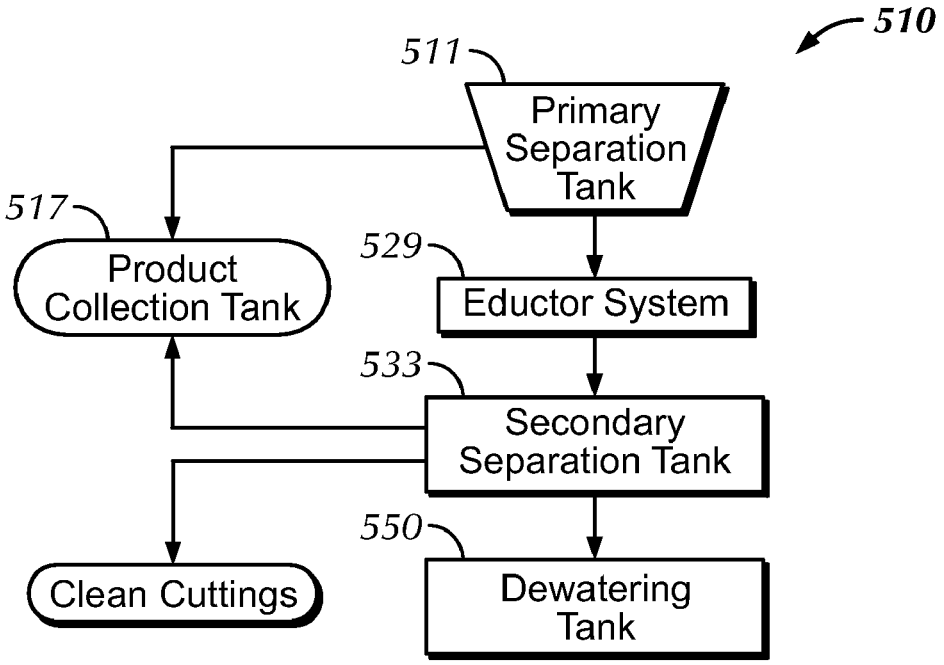
FIG. 5 is a block diagram of an alternate flow process in accordance with embodiments of the present disclosure.

Referring to FIG. 5, a block diagram of an alternate embodiment of a system 510 for removing bitumen oil is shown. Oil sand and water enter a primary separation tank 511 wherein bitumen oil is collected and transferred to a product collection tank 517. The remaining solids exit primary separation tank 511 and enter an eductor system 529. Eductor system 529 mixes the solids with water and transfers the slurry to a secondary separation tank 533. Secondary separation tank 533 may use a final particle separation device (e.g. 136 of FIG. 1) to remove fine particulate matter from the solution. The fine particulate matter may be separated out for collection. Bitumen oil may then removed from secondary separation tank 533, in any one of the processes described above, and transferred to product collection tank 517. Water from secondary separation tank may then be transferred to a dewatering tank 550. Remaining solid matter, including sand and clay, may then be removed from the water. The water may then be heated and pumped back into the system.

Figure 6:
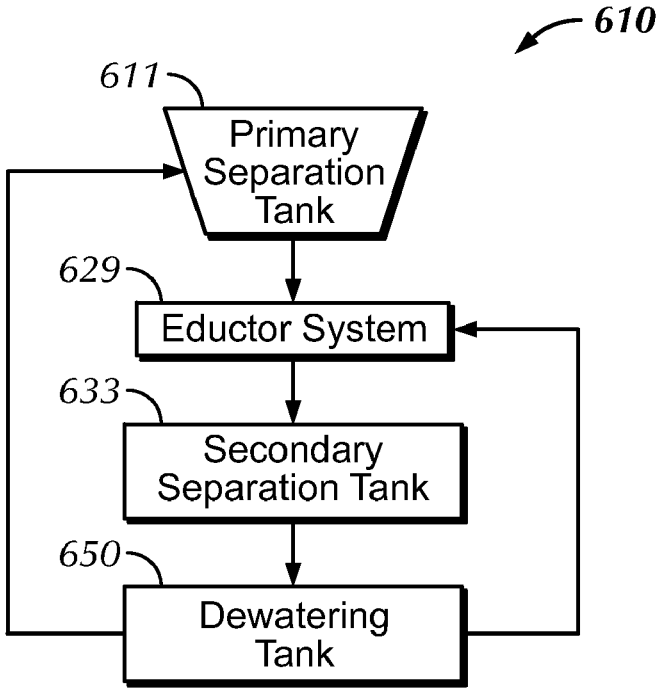
FIG. 6 is a block diagram of a closed loop water cycle of an embodiment of the flow process shown in FIG. 5.

Referring to FIG. 5 and FIG. 6 together, a water flow block diagram of a closed loop water cycle 610 of an embodiment of FIG. 5 is shown. Oil sand, cuttings, and other solid matter may enter system 510 through a first water inlet. Water from an outlet on a dewatering tank 650 may also flow into a water inlet of a primary separation tank 611, therein mixing with the solids as they are added to system 610. Water transfer between dewatering tank 611 and primary separation tank 611 may be assisted by an external water pump, or any other means of inducing water transfer, as described above.

Water may then flow from primary separation tank 611 into an eductor system 629. Eductor system 629 also receives water from dewatering tank 650. In one embodiment, the water may exit through an outlet in dewatering tank 650 and flow into a second water inlet of eductor system 629. The water transfer may be assisted by external water pump, a separate water pump, or any other means of inducing water transfer know to one skilled in the art. In eductor system 629, the water from dewatering tank 650 mixes with the solids and fluids from primary separation tank 611.

The water may then flow from a secondary separation tank 633 into a fine particle separation device. After processing in a fine particle separation device, the water may then flow back into secondary separation tank 633 or any partition of secondary separation tank thereof. The cycle of water from secondary separation tank 633 to the fine particle separation device may be induced by a transfer pump, or any other water flow device known to one skilled in the art.

Water from secondary separation tank 633 may then be transferred to dewatering tank 650. In dewatering tank 650, the water may be heated by an external source prior to being transferred to either primary separation tank 611 or eductor system 629. This embodiment of closed loop water cycle 610 may provide the same advantages as discussed above.

Figure 7:
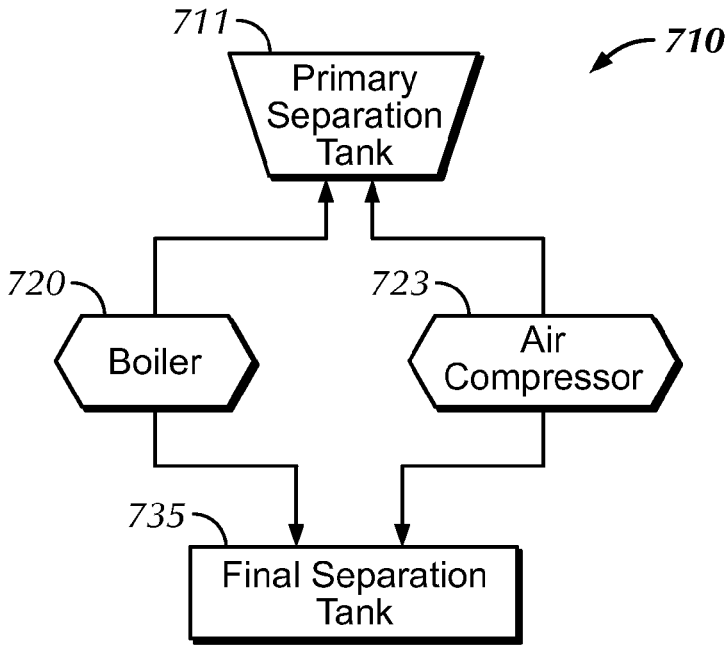
FIG. 7 is a block diagram of an auxiliary system in accordance with an embodiment of the present disclosure.

Finally, referring to FIG. 7, an auxiliary system 710 of an embodiment is shown. One example of auxiliary processing system 710 may include an air compression device 723 and a boiler 720. In one embodiment, air may be injected into a primary separation tank 711 and final separation tank 735 through air compression device 723. Upon injection into either primary separation tank 711, or final separation tank 735, the air flow may be manipulated to induce the formation of microbubbles in the water, which may increase the separation rate of bitumen oil from solids. In certain embodiments, an air flow rate of 1500 L/min may promote efficient bitumen oil separation. However, other embodiments may be foreseen wherein air is injected at different rates, or into different parts of a system (e.g. 110 of FIG. 1*b*).

A second example of auxiliary system 710 may include a boiler 720. Boiler 720 may receive water from a source either within the system, for example, from final separation tank (e.g. 135 of FIG. 1*b*), or an external source (not shown). In one embodiment, boiler 720 produces steam, and may inject the steam into primary separation tank 711 and final separation tank 735. The steam may be injected into primary separation tank 711 and final separation tank 735 at any level throughout the system which increases the separation rate of bitumen oil from solids.

While air compression device 723 and boiler 720 may make up an auxiliary system individually, in certain embodiments, it may be advantageous to inject both air and steam into a system (e.g. 110 of FIG. 1*b*). It should also be realized that other auxiliary systems may be foreseen wherein chemicals are used to further increase the efficiency of the separation of bitumen oil from solids.

Advantageously, embodiments of the aforementioned system may promote increased rates of separation of bitumen oil from solids. Because the system may use a closed loop water cycle, less water may be used, increasing efficiency, and decreasing costs. These cost saving may be further realized when the system uses a hot water process, chemical additives, or other means of increasing separation time. While decreasing costs associated with bitumen oil separation, the system may also decrease the production of hazardous waste material. Because of the closed cycle nature of the system, fewer resources are required to operate and maintain the processes. Furthermore, because the solid matter may be cleaned in multiple steps, sand and cuttings used to backfill petroleum extraction operations may contain less residual petroleum products and chemicals, thus being safer for the environment. Finally, the removed bitumen oil may contain less water by weight, decreasing the need for subsequent refinement operations, thereby increasing the speed of production while decreasing costs.

While the invention has been described with respect to a limited number of embodiments, those skilled in the art, having benefit of this disclosure, will appreciate that other embodiments can be devised which do not depart form the scope of the invention as disclosed herein. Accordingly, the scope of the invention should be limited only by the attached claims.

What is claimed is:

1. A method to separate hydrocarbons from a solid source comprising:

mixing a tarred solid source with water to create a slurry of water, solids and hydrocarbons in a primary separation tank, wherein the water is heated prior to mixing with the tarred solid source;

separating at least a portion of the hydrocarbons from the slurry in the primary separation tank by one of a group consisting of settling, floatation, mechanical agitation, water circulation, aeration, gravity separation, and counter-current decantation;

removing at least a portion of the separated hydrocarbons from the slurry in the primary separation tank;

transferring the remaining slurry into a secondary separation tank;

separating fine solid particles from the slurry;

removing additional hydrocarbons; and recycling the water.

2. The method of claim 1, wherein the pH of the slurry is above 10.

3. The method of claim 1, further comprising injecting steam into at least one of a group consisting of the primary separation tank and the secondary separation tank.

4. The method of claim 1, further comprising moving the solids in the primary separation tank with a chain-and-flight scraper.

5. The method of claim 1, further comprising passing the slurry through a solid separation device.

6. The method of claim 5, wherein the solid separation device comprises a hydrocyclone.

7. The method of claim 6, further comprising discharging solids from the hydrocyclone onto a shale shaker.

8. The method of claim 1, wherein the recycling comprises recycling water from the secondary separation tank to the primary separation tank.

9. The method of claim 1, wherein the removing at least a portion of the separated hydrocarbons from the slurry in the primary separation tank is removed with a skimmer.

10. The method of claim 1, further comprising agitating the slurry in the primary separation tank.

11. The method of claim 1, further comprising injecting air into at least one of the primary and secondary separation tanks.

12. The method of claim 1, wherein the hydrocarbons are separated from the slurry in the primary separation tank through counter-current decantation.

13. The method of claim 1, further comprising removing residual clay particles from the slurry in the secondary separation tank.

14. The method of claim 1, wherein the solids are deposited in the primary separation tank via a moveable inlet.

15. The method of claim 14, wherein the solids are selectively deposited in the primary separation tank at particular locations via the moveable inlet.

* * * * *